US008424456B2

(12) United States Patent
Broden et al.

(10) Patent No.: US 8,424,456 B2
(45) Date of Patent: Apr. 23, 2013

(54) NON-DUD SIGNATURE TRAINING CARTRIDGE AND PROJECTILE

(75) Inventors: David Broden, Orono, MN (US); Victor H. Strobush, Bloomington, MN (US); Corey Weis, Janesville, WI (US)

(73) Assignee: AMTEC Corporation, Janesville, WI (US)

( * ) Notice: Subject to any disclaimer, the term of this patent is extended or adjusted under 35 U.S.C. 154(b) by 128 days.

(21) Appl. No.: 12/888,170

(22) Filed: Sep. 22, 2010

(65) Prior Publication Data

US 2011/0079164 A1 Apr. 7, 2011

Related U.S. Application Data

(60) Provisional application No. 61/278,298, filed on Oct. 5, 2009.

(51) Int. Cl.
*F42B 8/08* (2006.01)

(52) U.S. Cl.
USPC ..... 102/444

(58) Field of Classification Search ..... 102/444–446, 102/502, 506, 498, 367, 370, 512, 513, 529
See application file for complete search history.

(56) References Cited

U.S. PATENT DOCUMENTS

| | | | | |
|---|---|---|---|---|
| 3,625,155 | A * | 12/1971 | Douda et al. | 102/334 |
| 4,915,028 | A | 4/1990 | Apotheloz | |
| 5,009,164 | A * | 4/1991 | Grinberg | 102/502 |
| 5,035,183 | A * | 7/1991 | Luxton | 102/502 |
| 6,158,348 | A | 12/2000 | Campoli | |
| 6,279,482 | B1 | 8/2001 | Smith et al. | |
| 6,497,181 | B1 | 12/2002 | Manole et al. | |
| 6,543,365 | B1 * | 4/2003 | Vasel et al. | 102/502 |
| 6,990,905 | B1 | 1/2006 | Manole et al. | |
| 7,086,337 | B2 * | 8/2006 | Klein | 102/502 |
| 7,331,293 | B2 * | 2/2008 | Saxby | 102/513 |
| RE40,482 | E | 9/2008 | Haeselich | |
| 7,487,728 | B2 | 2/2009 | Cranor | |
| 2005/0188886 | A1 * | 9/2005 | Vasel et al. | 102/502 |
| 2006/0032393 | A1 | 2/2006 | Haeselich | |
| 2006/0166171 | A1 | 7/2006 | Preston et al. | |
| 2007/0119329 | A1 | 5/2007 | Haeselich | |
| 2008/0053330 | A1 | 3/2008 | Haeselich | |

OTHER PUBLICATIONS

40mm M918 Target Practice Cartridge, retrieved from the Internet on Sep. 21, 2010, at http://www.fas.org/man/dod-101/sys/land/m918.htm.

(Continued)

*Primary Examiner* — Michael Carone
*Assistant Examiner* — Reginald Tillman, Jr.
(74) *Attorney, Agent, or Firm* — Greenberg Traurig, LLP

(57) ABSTRACT

A training cartridge projectile for use in either a plastic cartridge case or a conventional metal cartridge case is disclosed that contains no explosive material. The projectile has an insert having a body portion and a front end, a container overmolded onto the body portion of the insert, a frangible ogive fastened to the front end of the tubular insert; and a payload module within the ogive in front of the container carrying a non-explosive signature material for providing a visual indication of projectile impact to an observer upon projectile impact with an object. The module includes a hollow frangible ampoule containing the signature material, and a generally disc shaped base member engaging the insert and closing the ampoule. The base member preferably has a set of axially extending vanes engaging the signature material during spin-up as the projectile is accelerated through the bore of the weapon firing the projectile.

34 Claims, 10 Drawing Sheets

OTHER PUBLICATIONS

40mm M918 Cartridge Target Practice flier, from American Ordnance LLC web site, retrieved from the Internet on Sep. 21, 2010, at http://www.aollc.biz/pdf/M918.pdf.

International Search Report and Written Opinion, dated Jul. 28, 2011, from related International Application No. PCT/US2010/051476.

* cited by examiner

NON-DUD SIGNATURE TRAINING CARTRIDGE AND PROJECTILE

CROSS-REFERENCE TO RELATED APPLICATION

This application claims priority to U.S. Provisional Patent Application No. 61/278,298, filed Oct. 5, 2009, entitled "Non-Dud Signature Training Cartridge and Projectile," which is incorporated herein by reference in its entirety.

BACKGROUND OF THE DISCLOSURE

The present disclosure relates to ammunition and more particularly to training ammunition.

The United States Army uses 40 mm grenade machine guns within the tactical environment for defense, retrograde, patrolling, rear area security, urban operations, and special operations. These weapon systems are deployed in all environments, e.g., during the day and also limited visibility conditions, such as night, fog, and other obscurant conditions. The need for improvements in night fighting capabilities and the fielding of thermal weapon sights technology have lead to a training gap. There is also a need for a training capability which enables the war fighter to be able to "train as you fight." The current target practice cartridge provides an impact signature. However, it is limited in range to about 1299 meters during the day and 500 meters at night. Additionally the current target practice cartridge does not provide a thermal or infrared signature.

One conventional target practice cartridge, the M918 round, is shown in cross section in FIG. 1. This 40 mm cartridge 10 includes a M169 metal cartridge case 11 and a "flash/bang" projectile assembly 17. The case 11 has a base plug 12 which holds a percussion primer 14 in place adjacent a propellant charge 15 in a closing cup portion 16 of the case 11. The flash/bang projectile assembly 17 includes a projectile body assembly (steel body with copper rotating band swaged for retention thereon) forming a container 18 and an ogive 19 fastened onto the container 18. This container holds a capsule assembly 20 that holds a flash charge composition 21. Within the ogive 19 is a firing pin assembly 22, an anti creep spring 23, and a fuze escapement assembly 24 which, upon target impact, ignites the flash charge composition 21.

Around the outside of the projectile container 18 is a ring or band of material called the rotating band 25. This rotating band 25 engages lands and grooves in the bore of the barrel of the weapon to rotate the projectile 17 as it travels through the bore providing flight stability to the projectile 17 as it thereafter flies down range.

The M918 40 mm training round provides an impact signature out to beyond approximately 1000 meters. However, should the projectile 17 land in soft earth, the firing pin assembly malfunction, or the fuze assembly malfunction, it detrimentally also can produce an unexploded ordnance hazard. This is highly undesirable. Thus there is a need in military training regimens for use of training ammunition that does not involve energetic payloads, thus eliminating energetic unexploded ordnance risk.

SUMMARY OF THE DISCLOSURE

One embodiment of a non-dud signature training cartridge projectile in accordance with the present disclosure is sized to ballistically emulate a tactical high explosive projectile. For example, the projectile may be matched to emulate performance of either a U.S. military M430A1 high velocity 40 mm high explosive projectile or a M433 low velocity 40 mm high explosive projectile and its related M781 trainer Projectile. In this case "emulate" refers to similarity in weight, shape, and common ballistic flight characteristics. In each case, the payload module in the training cartridge projectile of the present disclosure may advantageously be interchanged with modules having different signature materials for differing training conditions and objectives.

The training cartridge projectile in such an embodiment includes an insert having a body portion and a front end, a container overmolded onto the body portion of the insert, a frangible ogive fastened to the front end of the tubular insert; and a payload module within the ogive in front of the container carrying a non-explosive signature material for providing a visual (day, night, thermal, and infrared (mid and long wave)) indication to an observer (human or otherwise) of projectile impact with an object.

The container provides the necessary rotating band to engage rifling lands in the bore of the weapon firing the projectile as well as providing the necessary structure for fit within a standard metal or plastic cartridge casing. The insert is structured to provide the required inertia and mass to ballistically match that of the real energetic projectile that the training cartridge projectile replaces. In each of the embodiments described herein, the ogive may be fastened to the front end of the tubular insert through an interference locking mechanism such as a threaded connection, modified threads, or snap fit interlocking ridges and grooves on the joining portions of the components.

The payload module in this exemplary projectile includes a hollow frangible ampoule containing the signature material, and a generally disc shaped base member engaging the insert and closing the ampoule. The base member preferably has a set of axially extending vanes (which may alternately be incorporated into the ampoule itself) extending into the signature material if the material is flowable, such as a powder or fluid. These vanes, or ribs, engage the signature material during spin-up as the projectile is accelerated through the bore of the weapon firing the projectile.

The base member may also have a rearwardly extending cylindrical portion adapted to fit within the front end of the insert to center and/or fasten the payload module to the insert. The vanes, or ribs, on the base member may be integrally formed thereon or may be separate and removably attached to the base member. In such an embodiment the front end of the insert may be internally configured to engage complementary features on the cylindrical portion of the base member to lock them together. Any type of fastening scheme may be used to join the components of the projectile. Threaded connections are but one example. Any interference fit or locking mechanism may be used in the projectile described herein such as modified threads, snap fit interlocking ribs/grooves, etc. to fasten the components together.

The signature material may include a single material or multiple materials. One preferred material with capability for multiple signature characteristics is a pyrophoric metal material such as coated iron that will ignite and burn to produce the desired signature parameters when the material is released upon target impact. In general, the signature material may be a solid, a liquid or a powder. The signature material also may be a material designed to provide an infrared signature for use at night, or produce smoke, sound, or some other indication of impact location.

In another embodiment of a projectile according to the present disclosure a non-dud signature module for use in a training projectile may include a cup shaped hollow frangible ampoule made of glass, plastic or frangible metal material, a base member closing the ampoule, and a pyrophoric signature material filling the ampoule between the base member and a front end of the ampoule. A tubular band around the ampoule and the base member in this embodiment has an internal shoulder engaging a portion of the ampoule and the band has a crimped portion engaging the base member to hold the base member and ampoule together. In this embodiment, a hermetic seal may also be provided over the rear of the ampoule to ensure that moisture is precluded from contact with the signature material. Further features, advantages and attributes of a projectile in accordance with the present disclosure are set forth below.

BRIEF DESCRIPTION OF THE DRAWINGS

The disclosure will be better understood when consideration is given to the following detailed description in conjunction with the various illustrated views in the drawings.

DETAILED DESCRIPTION

Figure 1:
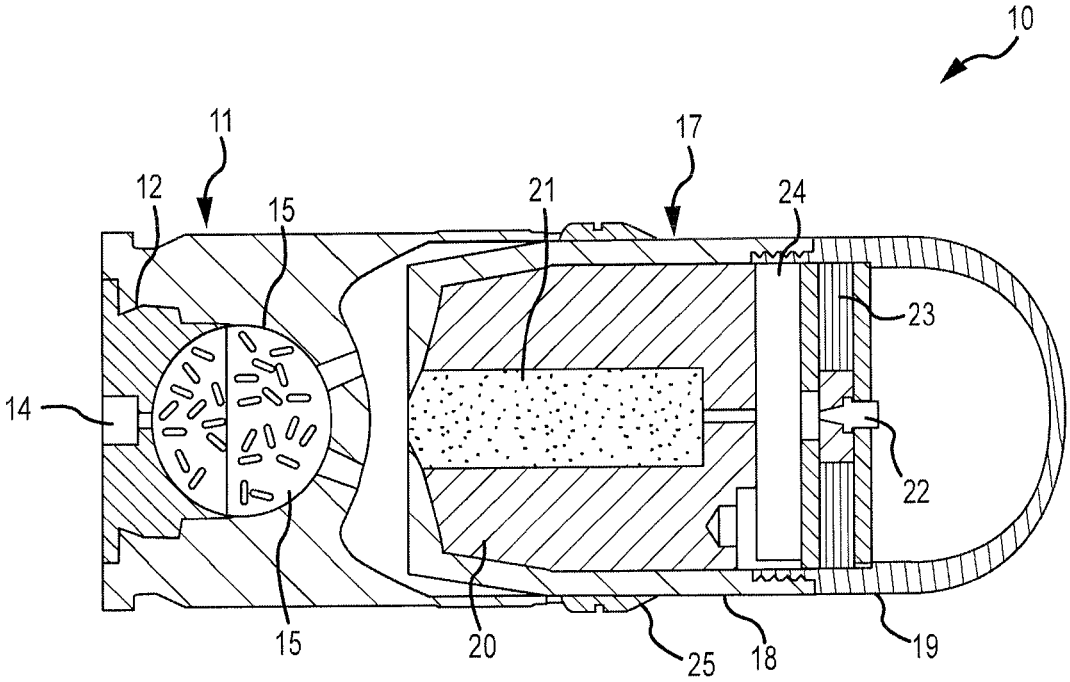
FIG.1 (PRIOR ART)
FIG. 1 is a cross sectional view of a conventional M918 practice grenade launcher cartridge.
Figure 2:
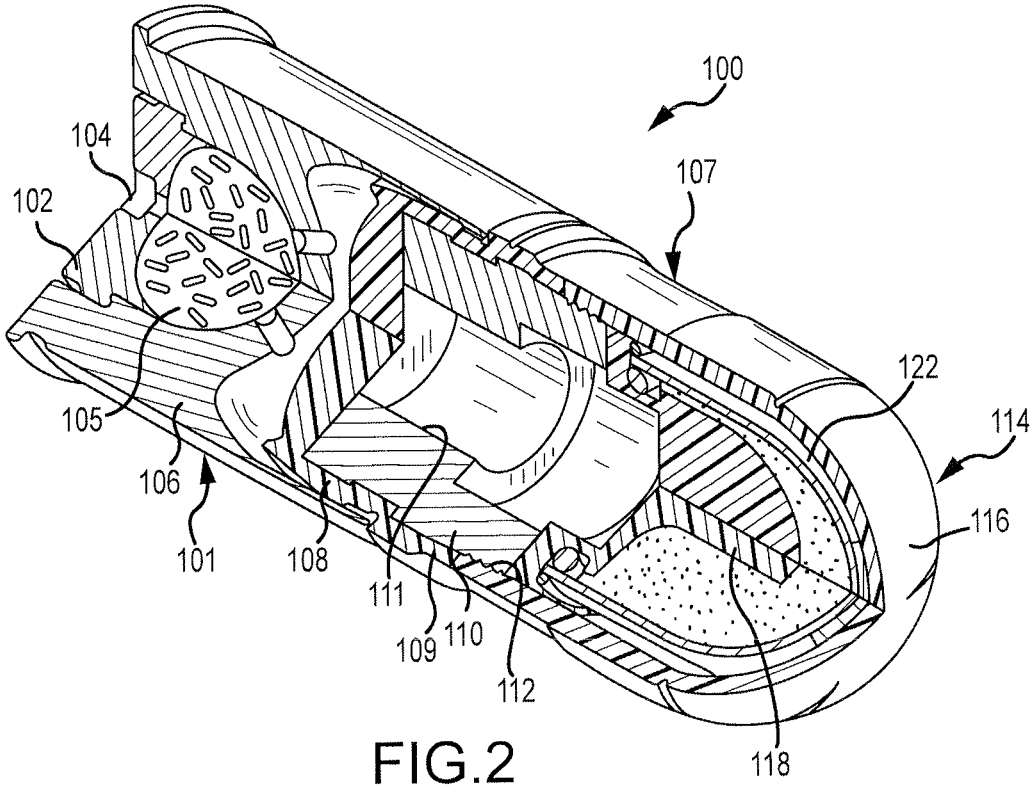
FIG. 2 is a perspective cutaway view of a non-dud signature training cartridge including a first embodiment of a high velocity non-dud signature projectile in accordance with the present disclosure.

A first embodiment of a non-dud signature training cartridge 100 in accordance with the present disclosure is shown in a perspective quarter section view in FIG. 2. This high velocity cartridge 100 includes a M169 metal cartridge case 101 supporting a non-dud projectile assembly 107 in accordance with this disclosure.

The case 101 has a base plug 102 which holds a percussion primer 104 in place adjacent a propellant charge 105 in a closing cup portion 106 of the case 101. The non-dud projectile assembly 107 is snap fit or crimped into the opening of the cartridge case 101. The projectile assembly 107 includes an outer projectile container 108 and an ogive 114 fastened onto the container 108 via an interference locking mechanism such as threads, modified threads, snap fit circumferential complementary interference ribs and grooves, etc. The container 108 holds an insert 110 that provides sufficient mass to equal the overall desired projectile mass such that the training projectile assembly 107 matches the mass of a live explosive containing projectile.

The projectile container 108, often called an "overmold" is a molded, plastic, hollow body that is molded in place, i.e., overmolded around and onto a bottom portion of the insert 110. The upper portion of the container or overmold 108 forms a peripheral rotating band 109 that engages the lands and grooves in the bore of the barrel of the weapon to rotate the projectile 107 as it travels through the weapon bore (not shown) providing flight stability to the projectile 107 as it thereafter flies down range. Preferably the container 108 has a solid base receiving and holding the insert 110. The insert 110 preferably has one or more annular peripheral steps or flanges that interlockingly engage the container 108 during the molding process such that the insert 110 and container 108 form a solid, unitary structure.

The insert 110 typically is made of aluminum or steel, may include a central cavity 111 and preferably has an attachment, e.g. male upper end portion 112 that extends out from the upper end of the overmold container 108. This attachment end portion 112 mates with a complementary shaped attachment feature, e.g. female interference locking feature, on the open end of a frangible ogive 114. The cavity 111 in the insert 110 may receive, in certain applications, a further body or substance for ballast in order to match the mass characteristics desired for a particular application. Alternatively, the insert 110 may simply be a solid body with precisely the particular mass required for the application needed. Thus the internal shape of the insert 110 may vary in accordance with payload mass such that the overall balance and mass of the projectile 107 matches that of a high explosive projectile that it is designed to emulate in its flight characteristics or other tactical characteristic features.

The ogive 114 is a hollow frangible plastic, ceramic, or brittle metal alloy body that has a rounded nose portion 116. The nose portion 116 preferably has a plurality of scored axially extending grooves either in its inner or outer surface to facilitate breakup of the ogive 114 upon target impact. The ogive 114 may preferably be made of a polymer material such as a nylon (glass filled) or other specialty polymer or a metal material which is designed and formed so as to fracture on target impact and thus release the signature material directly or through exposure of the ampoule to the impact signature anso thus releasing the signature material. The material and configuration has sufficient strength and durability to withstand cartridge handling, drop, and mechanical feeding and firing in the weapon system and to remain securely intact during ballistic flight until target impact and resulting fracture breakup of the ogive/ampoule configuration releasing the signature material or materials.

Figure 3:
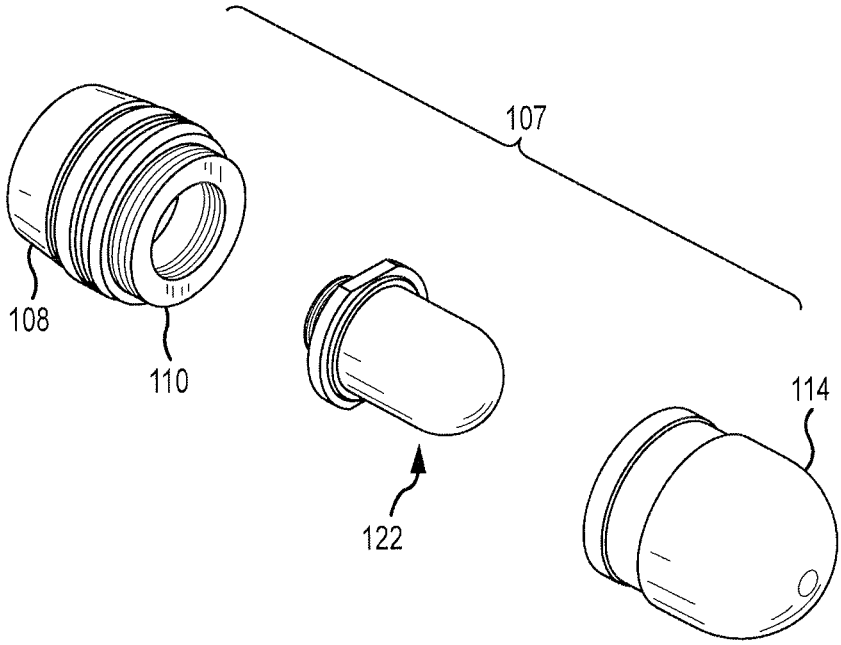
FIG. 3 is an exploded view of the first embodiment of a non-dud signature projectile incorporating features of the present disclosure shown in FIG. 2.

A payload module 122 is carried within the ogive 114. This payload module 122 is separately shown, assembled, in the exploded view of the projectile 107 in FIG. 3. The payload module 122 may be interchanged between different projectile applications because the container 108, insert 110, and ogive 114 remain the same and simply house the payload module 122. Furthermore, should conditions change it is conceivable that payload modules 122, containing different payloads, might be provided for use within a particular container 108, insert 110, and ogive 114 projectile configuration for varied or different training conditions. For example, a module for night operations may contain a signature material different than a module for daylight operations. Alternatively, the signature material may be chosen to provide only a plume or cloud signature rather than a visual light emission upon impact. Similarly the payload may be tailored to provide a signature of smoke, flare, marker or other functional capability. The configuration allows for modularity of the signature material without alternate projectile design or component configurations.

Thus a projectile in accordance with the present disclosure may be configured to have a choice of different payload modules 122 each having substantially the same physical configuration such that each may be carried within the ogive 114. The ammunition cartridge is thus a modular and adaptable configuration that may be defined, designed, and function to meet mission and operational needs. In all design and functional variants the configuration is adaptable to ensure similarity of the ballistic characteristics of other companion or related ammunition types used with the same weapon system.

Changes to cartridge configuration can thus be easily made. The ogive on each cartridge projectile need only be removed, or otherwise detached, and each of the modules 122 replaced with a substitute module. The projectile assembly enables insertion of the specific signature module assembly as a mission specific design adaptation if desired. The signature material may be a solid, liquid, granular or powder material depending on the desired signature characteristics and functional characteristics. When the payload module 122 is assembled between the insert 110 and the ogive 114, a resilient cushion 113 is placed between the front end of the module 122 and the inner nose surface of the ogive 114 to cushion and elastically retain in place the module inside the ogive 114. The cushion 113 is shown in FIG. 4.

Figure 4:
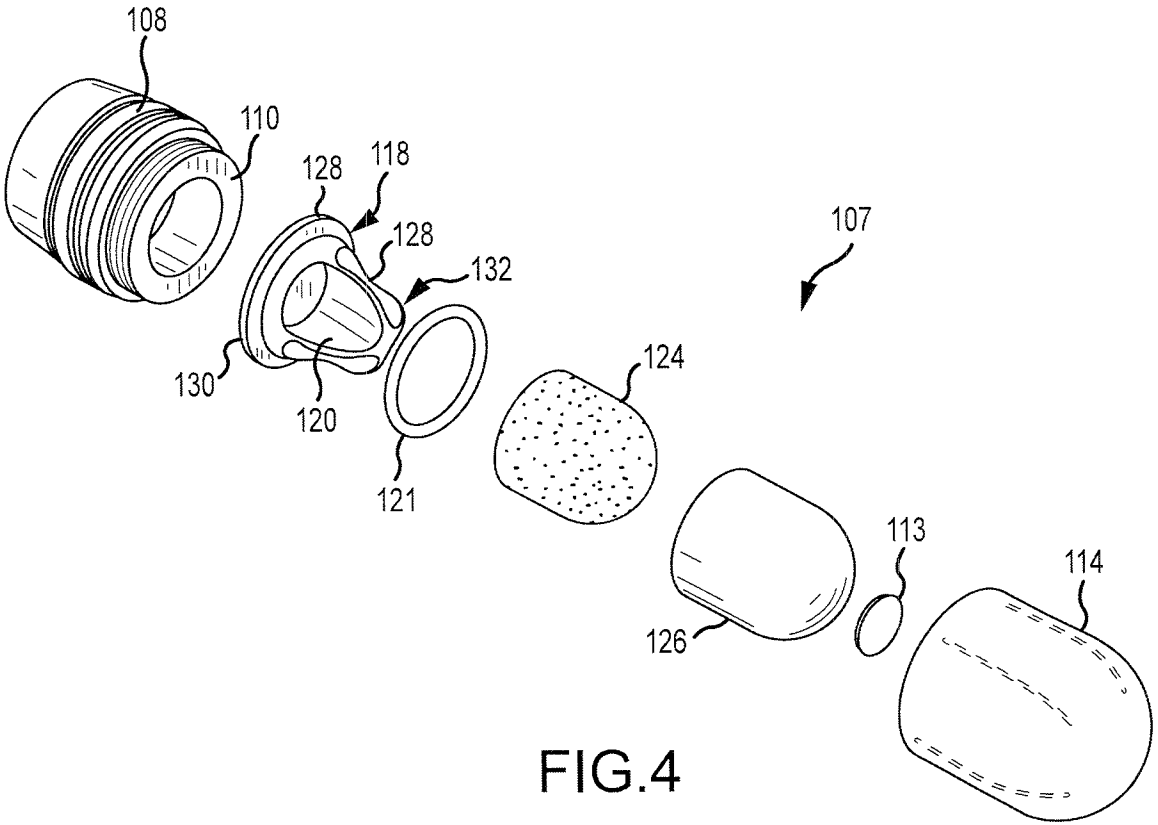
FIG. 4 is an expanded exploded view of the projectile shown in FIG. 3.

A further exploded view of the projectile 107 is shown in FIG. 4. Here the module 122 is shown separated into its respective internal components. These components are a base member 118 which includes a set of axially extending radial ribs or vanes 120, a seal ring 121, signature material 124, and a cup-shaped hollow ampoule 126. The base member 118 has a disc portion 128 which may have a flat rear face 130 for abutting against the forward face of insert 110. Extending axially from the disc portion 128 is a nose portion 132 which includes the axial set of radially extending ribs or vanes 120.

In the illustrated embodiment of the base member 118 shown in FIG. 4, there are integral axial extending ribs integral to the base or to the ampoule. The number of ribs will depend on the content and the texture of the signature material. For example, they may be in a cruciform shape spaced 90 degrees apart. The ribs 120 engage the signature material 124, if it is a loose material, to hold it in position within the ampoule 126 during "spin-up", i.e., rotational acceleration of the projectile assembly 107 as it travels down the bore of the weapon. Preferably there are three or four equally spaced radial ribs 120. However, the ribs 120 may be eliminated if the signature material 124 is a solid structure or acts as a solid during spin-up.

The signature material 124 in the payload module 122 (ogive, ampoule or ogive/ampoule combination) may be a frangible solid, a powder, or a granular mixture of signature materials. The signature characteristics may be provided by a single material module, a mix, or two or more within a single module or by multiple modules. Although solid materials are preferable, in specific applications, a gel or a liquid (singular or binary fluid) material might also be used. All signature materials are inert or contain no energetics or require no energetic for initiation. Signature materials may be enhanced with fluorescent or similar powder or fluid materials. Signature materials are tailored too achieve the signature visibility objectives (wave length, spectrum, intensity, etc.). An exemplary table of Signature material variants is shown in the following table.

| Material Definition | Material Form | Material Function | Material Variables | Signature Parameters |
|---|---|---|---|---|
| Inert Signature Material | Powder or granular, fluid, gel | Dispersed Cloud | Color Particle size | Color Particle size |
| Pyrophoric | Powder or Granular | Released from container--ignites, burns in air | Color, Intensity, Temperature | Wave Length(s) Duration, Intensity |
| Pyrophoric + inert signature material blend | Powder or granular | Released from container--ignites, burns in air | Color, Intensity, Temperature | Wave Length(s) Duration, Intensity |

A particularly advantageous signature material is a pyrophoric iron powder material available from Alloy Surfaces, Inc., a division of Chemring North America, Alloy Surfaces Technology Center, 1515 Garnett Mine Road, Boothwyn, Pa. 19061. This material is particularly sensitive to moisture and hence must be kept sealed and dry.

The ampoule 126 is preferably a hollow cup shaped body designed to fracture easily upon impact thus releasing the signature material resulting in formation and function of the signature characteristics. The ampoule may be the ogive itself with an appropriate coating to prevent moisture entry into the signature material, or a separate component shaped as a hollow cup. It may be made of a low permeable material or coated to provide for low permeability. Materials may be glass, a brittle plastic. a sealed barrier bag, or a ceramic material. It also may be made of a frangible/brittle material such as zinc, magnesium or other die cast materials. The ampoule may be configured with design features/grooves that facilitate fracture on impact. Its function is to contain the signature material and mate with the base portion 118 to form a unitary module 122.

The seal ring 121 may be a silicon rubber material and may be dispensed with if the ampoule 126 is heat sealed, snap fit, or otherwise fastened to the disc portion 128 of the base member 118, or if the signature material 124 is a solid structure. The ampoule 126 and base member 118 may alternatively be configured with interference locking connections so that they may be fastened together, or configured with features to permit them to be snap fit together to complete the closing structure of the module 122. In the illustrated embodiments herein, the signature material is a loose solid powder material.

In this embodiment 107, the inside surface of the frangible ogive 114 and/or the ampoule 126 may be coated with a material that prevents or retards signature material degradation such as moisture intrusion that could be detrimental to the functioning of the material. The signature material may be a day/night visual signature material, an infrared (IR) material, or a combination of materials that provide illumination in any anticipated atmospheric conditions. Furthermore, the inside surface of the ogive 114 and/or ampoule 126 may also be scored or grooved to facilitate breakage upon target impact.

Assembly of the projectile 107 begins with placing the ampoule 126 nose down, and loading the ampoule 126 with the signature material 124. The base member 118 is then inserted with the ribs 120 extending into the signature material 124 in the ampoule 126 to close the ampoule 126. The seal member 121 (metal, foil tape, environmental tape or epoxy) is then placed around the base of the ampoule 126. The projectile 107 is then assembled (optionally with a cushion 113 in the nose of the ogive 114) with the module 122 inserted into the ogive 114. Finally, the insert 110 projecting from the container 108 is fastened to the ogive 114 to complete the assembly of the projectile 107.

Figure 5:
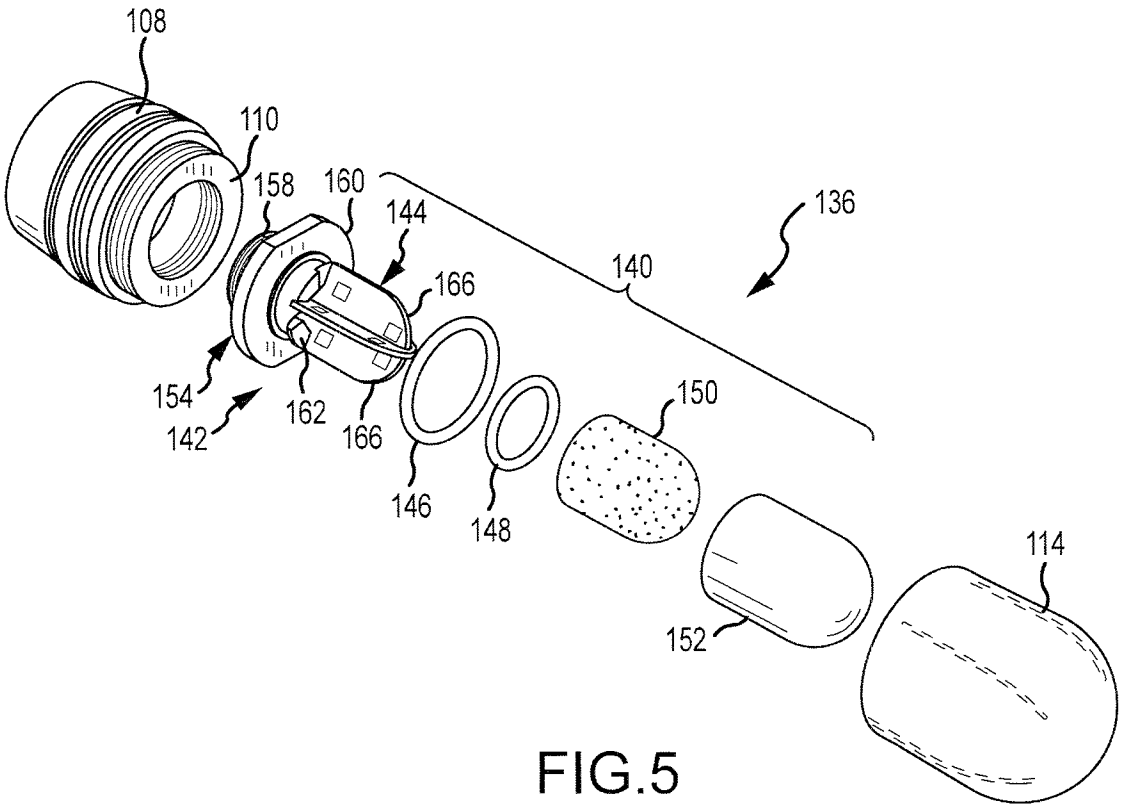
FIG. 5 is an expanded exploded view as in FIG. 4 showing an alternative base assembly of the payload module.

An exploded view of another embodiment of a projectile 136 in accordance with the present disclosure is shown in FIG. 5. This projectile 136 is identical to that shown in FIGS. 2-4 except for the payload module. The projectile 136 again has a base container 108 overmolded to a tubular insert 110, and has a frangible ogive 114 fastened to the front end of the insert 110. Contained within the ogive 114 is a payload module 140. This payload module 140, when assembled, is dimensioned identically to payload module 122 described above, and thus they are interchangeable.

This payload module 140 has a base member 142, a set 144 of removable ribs/vanes 166, a set of seal rings 146 and 148, a signature material 150, and a frangible ampoule 152. The base member 142 is somewhat different than that in module 122. Base member 142 has a separate base 154 and set 144 of separate ribs 166. Base 154 has a cylindrical rear portion 158 sized to slip within the cavity opening of the insert 110, and has a disc flange portion 160 which abuts the front face of the insert 110. Furthermore, base 154 has a cylindrical front portion 162 configured with intersecting slots 164 to receive the separate ribs 166. This arrangement permits various rib configurations to be utilized in the module 140 to test for optimum signature material performance in actual operation of the projectile 136. A set of O-ring seal rings 146 and 148 together are used to seal the ribs 166 and signature material 150 within the frangible ampoule 152 and complete the assembly of the module 140.

Assembly of the payload module 140 begins with loading of the ampoule 152. The ampoule 152 is positioned nose down. Signature material 150 is then placed into the ampoule 152. The seal ring 148 is then placed on the base member 142 with ribs 166 attached. The assembled base is then inserted into the open end of the ampoule 152 and fastened thereto. The seal ring 146 is placed on the assembled ampoule 152 around the base member 142 to complete the assembly of the payload module 140

Figure 6:
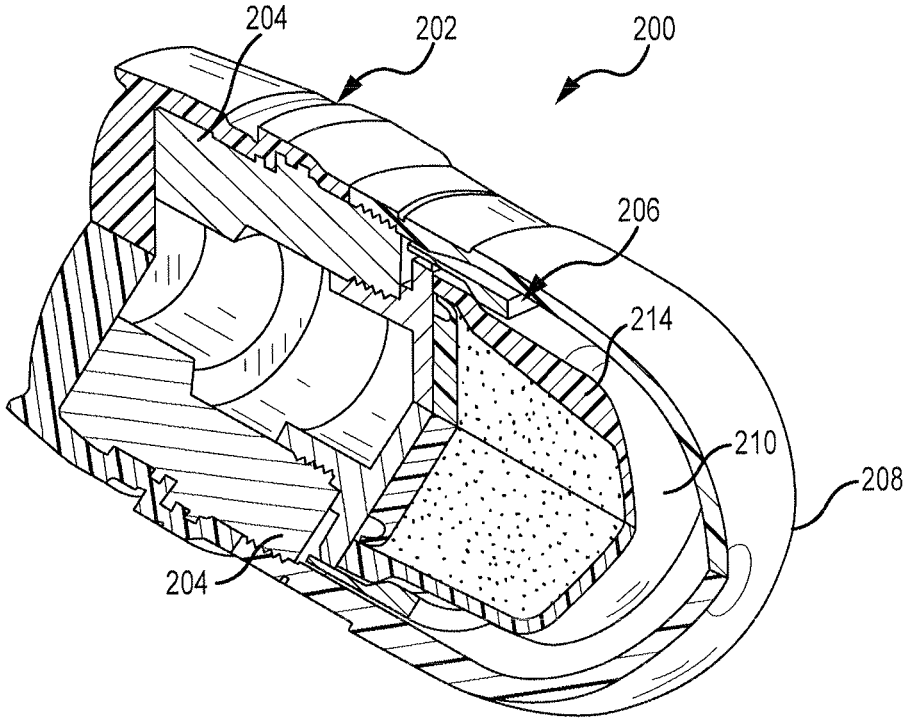
FIG. 6 is a perspective cutaway view of a second embodiment of a non-dud signature projectile in accordance with the present disclosure.
Figure 7:
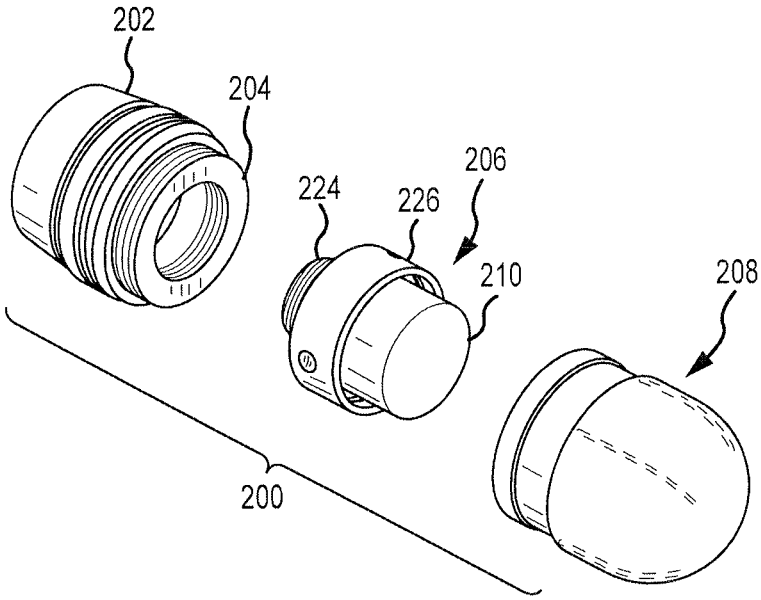
FIG. 7 is an exploded view of the second embodiment shown in FIG. 6.
Figure 8:
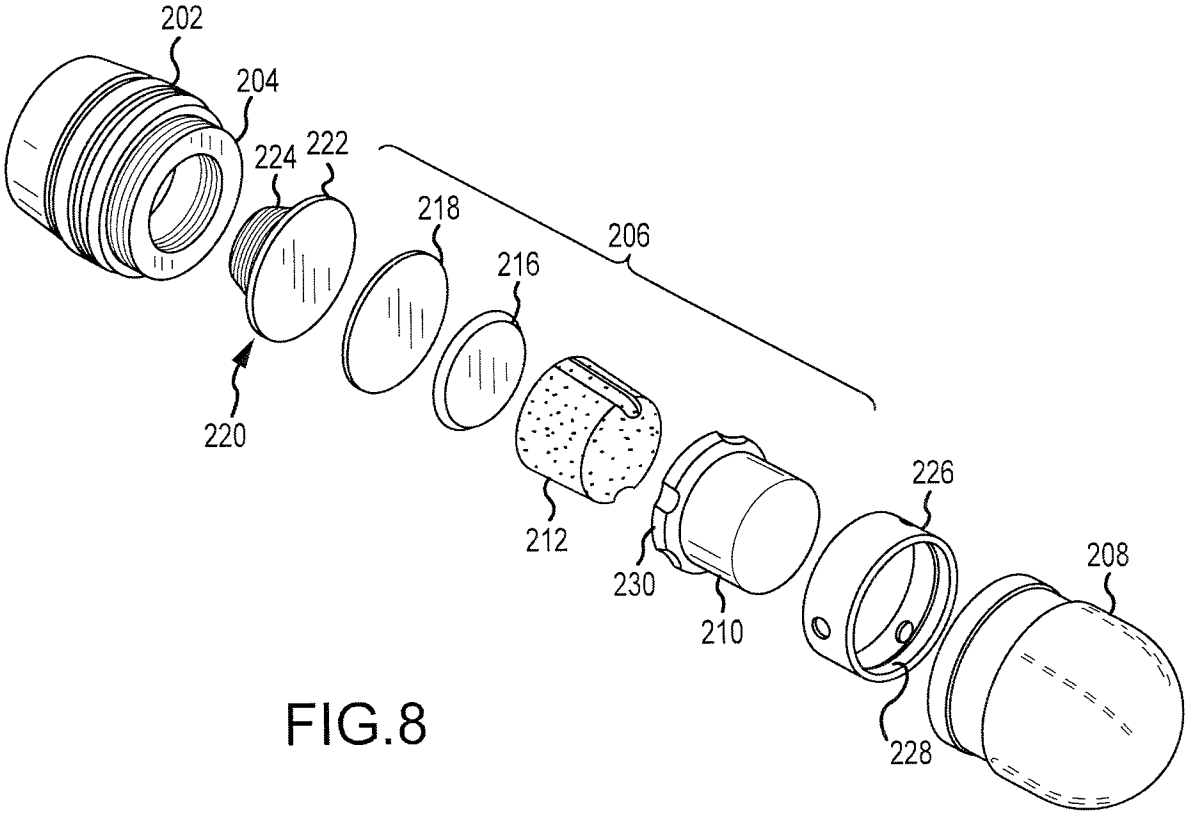
FIG. 8 is a further exploded view of the projectile FIGS. 6 and 7 showing the internal components of the payload module.

Another embodiment of a high velocity non-dud safety training projectile 200 is shown in FIGS. 6 through 8. An assembled projectile 200 is shown in FIG. 6 with a quarter cut away to reveal the internal structure of the projectile 200. FIG. 7 is an exploded view of the projectile 200 similar to that shown in FIG. 3. Finally, FIG. 8 is a further exploded view of the projectile 200 showing the various components of the payload module 206.

Projectile 200 includes a base container 202 overmolded onto a cylindrical insert 204, a payload module 206, and a frangible ogive 208 fastened to a front portion of the cylindrical insert 204. The payload module 206 is structured and sized such that it could be interchanged with modules 122 and 140 described above with reference to projectiles 107 and 136.

In this particular embodiment, the insert 204 is a generally tubular cylindrical body that has a series of annular peripheral external "T-knurl" ribs 210 that interlock with the overmolded base container 202 to provide a strong, unified, integral structure. Alternatively, the insert and overmolded base could have different rib structures to equivalently provide the integral structure. Also, an additional sub-insert could be provided to provide additional mass within the insert 204, if needed, to provide exact mass equivalence to an energetic projectile being simulated by the non-dud signature training projectile 200. The exposed front end of the insert 204 preferably has external interference locking features 205 to engage internal complementary locking features in the open end of the ogive 208 to assemble the ogive 208 to the container 202 with the payload module 206 therebetween.

This training projectile 200 differs from the previous two embodiments 107 and 136 primarily in the construction of the payload module 206. Again, the module 206 has an ampoule 210 containing a signature material 212. However, rather than having ribs fastened to or integral with a base member, the ampoule 210 has a series of internal axial vanes 214 that project radially inward.

The ampoule 210 is a hollow cup shaped frangible body that may be formed of a brittle plastic/polymer, glass, ceramic, or other such material, with the integral internal ribs or vanes 214. These vanes 214 are designed to prevent movement of the signature material during spin-up of the projectile during in-bore flight as in the first two embodiments described above. Again, the signature material 212 may be a loose powder material, fluid, or a solid structure. In the case of a solid structure, the signature material 212 may be complementarily shaped so as to slip easily within the ampoule 210, with cuts or depressions formed to match the shape and configuration of the interior vanes 214. In the exploded view of FIG. 8, the signature material appears as a solid block. However, this is merely illustrative only. More preferably the signature material 212 will be a loose solid material.

Behind the signature material 212 is a closure disc 216 followed by an inductive seal 218. This seal 218 adheres to the rim of the rear open end of the ampoule 210 to retain the closure disc 216 and signature material 212 inert within the ampoule 210. In this particular embodiment a signature material such as iron powder, could be degraded by moisture. The seal 218 provides hermetic sealing to prevent any humidity from reaching the signature material 210. Finally, behind the seal 218 is a base member 220. The base member 220 has a peripheral flange 222 and an axially extending cylindrical portion 224 designed to fit within the insert 204.

The seal 218 in conjunction with the closure disc 216 is designed to retain the signature material 212 within the ampoule 210. The ampoule 210 and base member 220 are held together by a retaining ring 226. This retaining ring 226 is preferably crimped in place to capture the flange 222 of the base member 220 and sealed ampoule 210 together. The retaining ring 226 has an internal shoulder 228 which engages a peripheral flange 230 on the ampoule 210. Preferably the retaining ring 226 may be made of thin metal such as aluminum or steel, although other materials may be used.

The cylindrical portion 224 of the base member 220 may have external interference locking mechanism features so that it can be snap fit or otherwise fastened together with corresponding internal features in the insert 204 such that there is no need for a cushion 113 between the nose of the ampoule 210 and the internal front end of the ogive 208.

Assembly of the module 206 begins with placing the ampoule nose down, inserting the signature material 212 into the ampoule 210, placing a closure disc 216 over the signature material 212, placing a seal 218 over the open rear end of the ampoule 210 and sealing the seal 218 in place. The base member 220 is placed over the seal 218 on the ampoule 210 and retaining ring 226 is telescopically slid over and onto the ampoule and base member 220. The retaining ring 226 is then crimped over the flange 222 of the base member 220 to complete the assembly of the payload module 206. The projectile 200 is then assembled by fastening portion 224 into the insert 204 and the ogive 208 is fastened onto the insert 204.

The ampoule 210 may be made of metal, a ceramic material, a plastic, or glass. For example, it may be made of a metal material such as a zinc die cast, die cast magnesium and other similar materials that is strong but brittle. Such a die cast ampoule could preferably be configured with a series of radially extending ribs or grooves to facilitate breakup of the ampoule upon target impact. As with each of the ogives 114, 208, the ampoule 210 may include internal or external score lines for this purpose.

Figure 9:
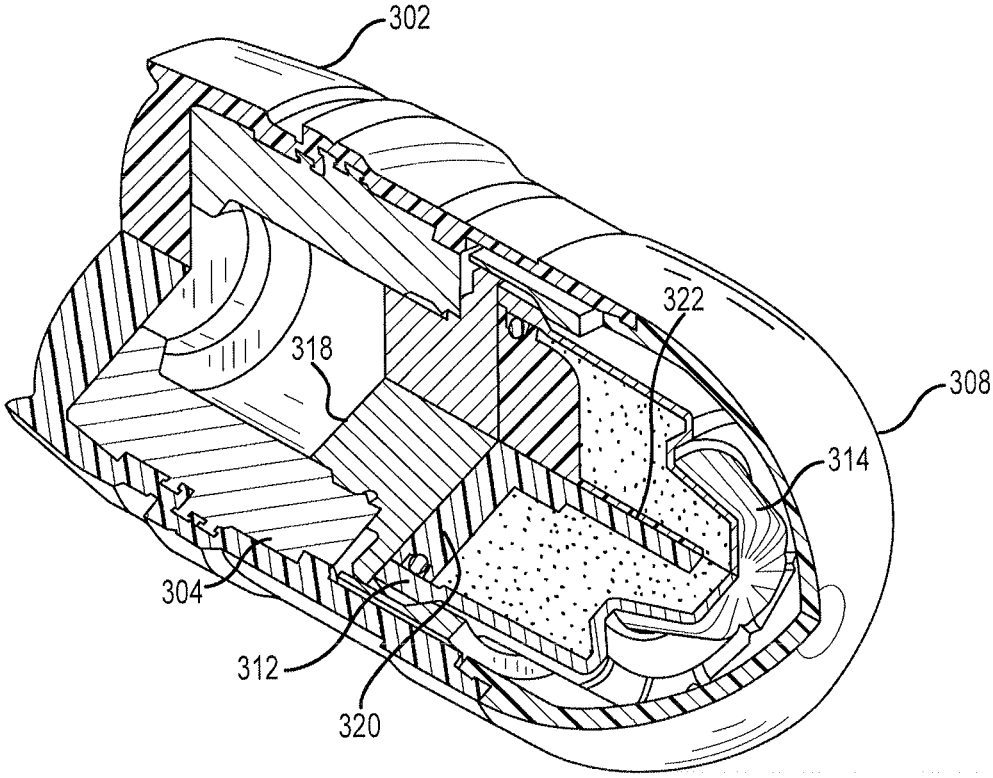
FIG. 9 is a perspective cutaway view of an alternative projectile to that shown in FIGS. 6 and 7 in which the ampoule housing includes frangible features.

A still further embodiment 300 of a non-dud signature training projectile in accordance with this disclosure is shown in perspective view with portions cut away in FIG. 9. The projectile 300 comprises an overmold container 302 on an insert 304, a payload module 306, and an ogive 308 enclosing the payload module 306 on the insert 304. The structure of the container 302, the insert 304 and the ogive 308 is the same as in the projectile 200 described above.

The payload module 306 in this embodiment again includes a signature material 307 but differs from the module 206 first in the structure of the ampoule. The ampoule 310 is again a cup shaped frangible body, preferably made of a zinc die-cast, with a peripheral flange 312 around the open end and an indented, recessed, nose portion 314 that incorporates a series of radially directed ribs 316 to enhance the frangibility of this ampoule 310. The payload module 306 includes a base member 318 that has a peripheral flange and a cylindrical portion as in the previous embodiment 206. However, in this payload module 306, a closure disc 320 has a set of axially extending ribs 322 that extend into the signature material 307 as in the first two embodiments rather than there being ribs 214 on the inside of the ampoule 210 as in module 206.

The payload module 306 is held together by a retaining band 324 that engages the flange 312 of the ampoule 310 and is crimped over the peripheral flange of the base member 318. When assembled, the payload module 306 is interchangeable with the module 206 above described. The principal difference is in the placement of the ribs for maintaining position of the signature material during spin-up. In the payload module 306, the ribs 322 are on the closure disc 320 rather than being formed in the ampoule 310 as in the ampoule 210. However, the ampoule 210 alternatively could be used in the payload module 306 instead of the ampoule 306.

Figure 10:
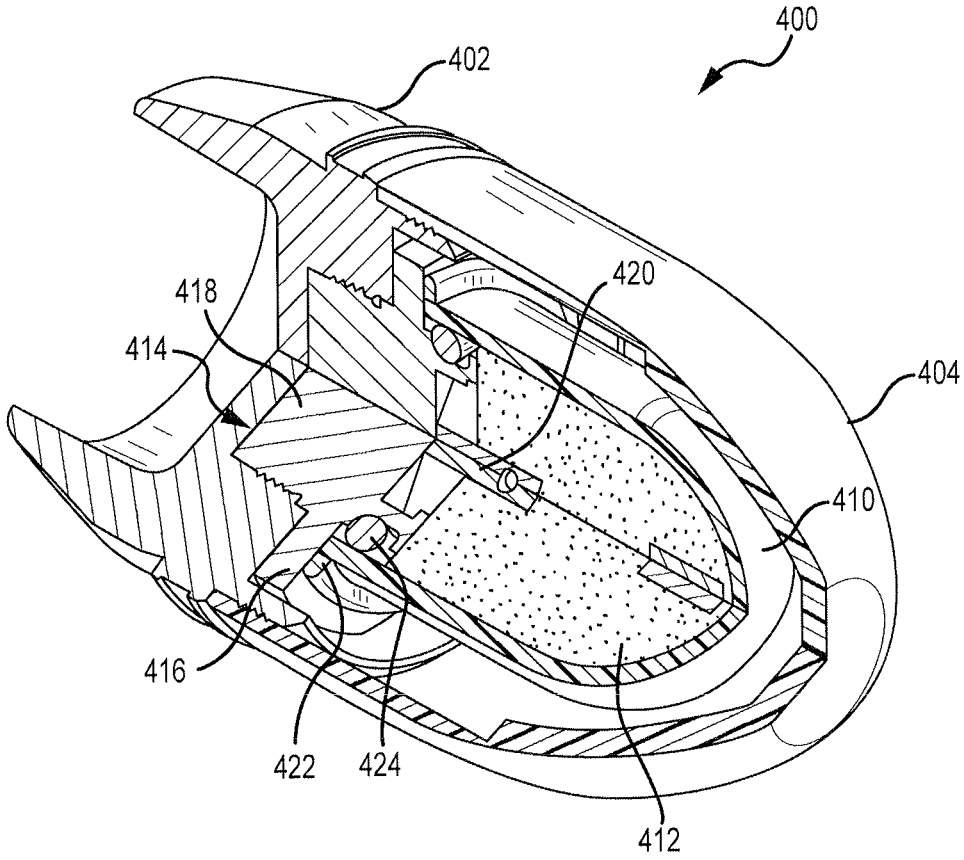
FIG. 10 shows a perspective cutaway view of a third embodiment which is a low velocity non-dud signature projectile including a payload module as shown in FIGS. 3 and 4 in accordance with the present disclosure.

Another exemplary embodiment 400 of a non-dud signature training projectile is shown in FIG. 10. Again, the projectile 400 has a container 402 and an ogive 404 containing a payload module 406 therebetween. However, this embodiment 400 is designed as a low velocity projectile, and thus the container 402 has a somewhat different shape than the containers 108, 202 and 302 above described. Here, the container 402 is a single material structure, designed to fit within a plastic cartridge case such as an M212 snap fit cartridge case or an M118 cartridge case such that the low velocity projectile 400 is ballistically matched to the M433E1 high explosive projectile. Alternatively, the projectile 400 may be utilized with a modified pistol cartridge propulsion system. The container 402 may preferably be a modified M781 zinc alloy body with integral rotating band.

In this embodiment, the ogive 404 is threaded onto the container 402 rather than onto an insert 204 or 304 as previously described. However, the ogive 404 and container 402 still confine and hold the payload module 406. The payload module 406 can be interchangeable with modules 122, 206 and 306.

In this particular embodiment 400, the payload module 406 has a hollow cup shaped ampoule 410 containing a signature material 412 and has a base member 414. The base member 414 has a peripheral flange 416 and a cylindrical portion 418 that is fastened to the container 402. The base member 414 also carries a set of axially extending ribs 420 that extend into the signature material 412 as in the prior embodiments. The ampoule 410 is captured onto the base member 414 between a pair of seal rings 422 and 424.

Again, the mass and mass distribution of the projectile 400 is designed to match the characteristics of a live low velocity projectile. Thus the particular configuration of the base member 414 and container 402 depend on the particular projectile being emulated.

Other variations in configurations other than as specifically described above and shown in the Figures may also be utilized. All such variations are within the scope of the present disclosure. For example, the retaining sleeve or band 324 may be replaced with a swaged clamp ring or other closure that holds the ampoule and base together. For example, the band 324 may be replaced by an adhesive closure or the ampoule and base member may each be threaded or provided with complementary pin and slot fasteners to hold them together.

The ampoule 314, 410, 210, and 152 may each be formed of glass, a ceramic, or brittle metal material. The ampoules are preferably more breakable than the ogive 114, 208, 308 and 404. However, both may be constructed from the same or similar materials. In each of the embodiments 100, 136, 200, 300 and 400 the vanes 118, 120, 166, and 322 may alternatively be replaced with internal vanes formed in the inside surface of the ampoules instead of on the base members. Furthermore, if the signature material is a solid structural body, the vanes may be eliminated, as there would be no need for them to ensure spatial integrity during spin-up. All such modifications, enhancements, variations and alternatives are within the scope of the present disclosure, the scope of which is defined by the following claims.

What is claimed is:

1. A non-dud signature training cartridge projectile sized to ballistically emulate a high explosive projectile, the training cartridge projectile comprising:

an insert having a body portion and a tubular front end;

a cup shaped container forming a rear end portion of the projectile fastened to the body portion of the insert, wherein the tubular front end of the insert extends beyond the container;

a frangible ogive fastened to the tubular front end of the insert; and a payload module fastened to the insert within the ogive in front of the container carrying a non-explosive signature material for providing a detectable indication of projectile impact to an observer upon projectile impact with an object.

2. The projectile according to claim 1 wherein the payload module comprises:

an ampoule;

a signature material in the ampoule; and a generally disc shaped base member engaging the insert and closing the ampoule.

3. A non-dud signature training cartridge projectile sized to ballistically emulate a high explosive projectile, the training cartridge projectile comprising:

an insert having a body portion and a tubular front end;

a cup shaped container forming a rear end portion of the projectile fastened to the body portion of the insert;

a frangible ogive fastened to the tubular front end of the insert; and a payload module fastened to the within the ogive in front of the container parrying a non-explosive signature material for providing a detectable indication of projectile impact to an observer upon the projectile impact with an object, wherein the payload module comprises an ampoule, a signature material in the ampoule; and a generally disc shaped base member engaging the insert and closing the ampoule, wherein the base member comprises a set of axially extending radial vanes protruding outwardly into the signature material.

4. The projectile according to claim 3 wherein the vanes are removably attached to the base member.

5. The projectile according to claim 3 wherein the vanes are integrally formed on the base member.

6. The projectile according to claim 3 wherein the signature material comprises a pyrophoric material.

7. The projectile according to claim 6 wherein the ogive is a frangible polymeric cup that has an open rear end and has interior axially extending grooves to enhance breakup of the ogive upon impact.

8. The projectile according to claim 7 wherein the rear end of the ogive is internally threaded to engage threads on the front end of the insert.

9. The projectile according to claim 3 wherein the payload module is held in place between the front end of the insert and the ogive by a cushion.

10. A non-dud signature training cartridge projectile sized to ballistically emulate a high explosive projectile, the training cartridge projectile comprising:

an insert having a body portion and a tubular front end;

a cup shaped container forming a rear end portion of the projectile fastened to the body portion of the insert;

a frangible ogive fastened to the tubular front end of the insert; and a payload module fastened to the insert within the ogive in front of the container carrying a non-explosive signature material for providing a detectable indication of projectile impact to an observer upon projectile impact with an object, wherein the payload module comprises an ampoule, a signature material in the ampoule, and a generally disc shaped base member engaging the insert and closing the ampoule, wherein the base member has a rearwardly extending cylindrical portion adapted to fit within the front end of the insert.

11. The projectile according to claim 10 wherein the front end of the insert is internally threaded to engage threads on the cylindrical portion of the base member.

12. The projectile according to claim 10 wherein the ampoule and base member of the payload module are held together by a band.

13. The projectile according to claim 12 wherein a nose portion of the ampoule includes a plurality of radially directed ribs.

14. The projectile according to claim 12 further comprising a plurality of axially extending vanes in the signature material within the ampoule.

15. The projectile according to claim 14 wherein the vanes are separate from the base member.

16. The projectile according to claim 14 wherein the vanes are integrally formed in the base member.

17. The projectile according to claim 14 wherein the base member has a rearwardly projecting threaded cylindrical portion adapted to engage internal threads in the front end of the insert.

18. The projectile according to claim 10 wherein the module includes a hermetic seal over a rear end of the ampoule to preclude moisture entry into the signature material.

19. A non-dud signature module for use in a training projectile comprising:

a cup shaped hollow frangible ampoule;

a base member closing the ampoule; and a pyrophoric signature material filling the ampoule between the base member and a front end of the ampoule, wherein the base member has a plurality of axially extending radial vanes protruding outward into the signature material.

20. The module according to claim 19 further comprising a tubular band around the ampoule and the base member, wherein the band has an internal shoulder engaging a portion of the ampoule and a crimped portion engaging the base member to hold the base member and ampoule together.

21. The module according to claim 19 wherein the vanes are separable from the base member.

22. The module according to claim 20 wherein the base member has a threaded cylindrical portion adapted to engage a threaded insert in a projectile container.

23. The module according to claim 19 wherein the ampoule includes a plurality of radial ribs.

24. The module according to claim 23 wherein the ampoule is made of a material selected from the group consisting of zinc, zinc die cast, and magnesium die cast.

25. A non-dud signature training cartridge projectile sized to ballistically emulate a high explosive projectile, the training cartridge projectile comprising:

a generally tubular insert having a body portion and a front end;

a cup shaped container forming a rear end portion of the projectile overmolded onto the body portion of the insert, wherein the tubular insert has a plurality of peripheral annular ribs interlocking the container and insert together;

a frangible ogive fastened to the front end of the tubular insert; and a payload module within the ogive in front of the container carrying a non-explosive pyrophoric signature material for providing a visual indication of projectile impact to an observer upon projectile impact with an object.

26. The projectile according to claim 25 wherein the payload module comprises a frangible ampoule containing the signature material and a base member closing the ampoule.

27. The projectile according to claim 26 wherein the payload module is removably fastened to the front end of the insert.

28. The projectile according to claim 27 wherein the payload module includes a hermetic seal between the ampoule and the base member.

29. The projectile according to claim 25 wherein the ogive is removable from the insert to permit installing different payload modules within the projectile.

30. A non-dud signature training cartridge projectile sized to ballistically emulate a high explosive projectile, the training cartridge projectile comprising:

an insert having a body portion and a tubular front end;

a cup shaped container forming a rear end portion of the projectile receiving at least the body portion of the insert, wherein the tubular front end of the insert extends beyond the container;

a frangible ogive over the tubular front end of the insert; and a payload module fastened to the insert within the ogive in front of the container carrying a non-explosive signature material for providing a detectable indication of projectile impact to an observer upon projectile impact with an object.

31. The projectile according to claim 30, wherein the payload module comprises;

an ampoule, a signature material in the ampoule, and a generally disc shaped base member engaging the insert and closing the ampoule.

32. The projectile according to claim 31, wherein the base member comprises a set of axially extending radial vanes protruding outwardly into the signature material.

33. The projectile according to claim 31 wherein the base member has a rearwardly extending cylindrical portion adapted to fit within the front end of the insert.

34. The projectile according to claim 33 wherein the front end of the insert is internally threaded to engage threads on the cylindrical portion of the base member.

* * * * *

UNITED STATES PATENT AND TRADEMARK OFFICE

CERTIFICATE OF CORRECTION

PATENT NO. : 8,424,456 B2
APPLICATION NO. : 12/888170
DATED : April 23, 2013
INVENTOR(S) : Broden et al.

It is certified that error appears in the above-identified patent and that said Letters Patent is hereby corrected as shown below:

In the Claims

In Column 10, Line 61, in Claim 3, delete “the within” and insert -- the insert within --, therefor.

In Column 10, Line 62, in Claim 3, delete “parrying” and insert -- carrying --, therefor.

In Column 10, Line 64, in Claim 3, delete “the projectile” and insert -- projectile --, therefor.

In Column 12, Line 63, in Claim 31, delete “comprises;” and insert -- comprises: --, therefor.

Signed and Sealed this
Nineteenth Day of November, 2013

Teresa Stanek Rea

Teresa Stanek Rea
*Deputy Director of the United States Patent and Trademark Office*